US006094172A

United States Patent [19]

Koscica et al.

[11] Patent Number: 6,094,172

[45] Date of Patent: Jul. 25, 2000

[54] HIGH PERFORMANCE TRAVELING WAVE ANTENNA FOR MICROWAVE AND MILLIMETER WAVE APPLICATIONS

[75] Inventors: Thomas Koscica, Clark, N.J.; Duc Huynh, Upper Darby, Pa.

[73] Assignee: The United States of America as represented by the Secretary of the Army, Washington, D.C.

[21] Appl. No.: 09/128,641

[22] Filed: Jul. 30, 1998

[51] Int. Cl.[7] ..... H01Q 11/02

[52] U.S. Cl. ..... 343/731; 343/700 MS; 343/737; 343/738

[58] Field of Search ..... 343/700 MS, 731, 343/792.5, 853, 737, 738; H01Q 11/02

[56] References Cited

U.S. PATENT DOCUMENTS

| | | | |
|---|---|---|---|
| 3,716,867 | 2/1973 | Mayes et al. | 343/701 |
| 4,238,798 | 12/1980 | Aitken et al. | 343/700 MS |
| 5,712,644 | 1/1998 | Kolak | 343/700 MS |

OTHER PUBLICATIONS

Article entitled "Microstrip Series Arrays," Tom Meltzler, Aerospace Systems Division, pp. 20–1 to 20–16.

Article entitled "Comparison of Three Series Fed Microstrip Array Geometries," D. Pozar and D. Schaubert, Electrical and Computer Engineering, University of Massachusetts at Amherst, pp. 728–731.

*Primary Examiner*—Don Wong
*Assistant Examiner*—Shih-Chao Chen
*Attorney, Agent, or Firm*—Paul S. Clohan, Jr.; Mark D. Kelly

[57] ABSTRACT

A traveling array antenna which operates at microwave/millimeter frequencies is disclosed in which a like number of radiator elements are arranged in two mirror image branches, an RF signal feed is fed through a 180 degree compensating power splitter to each branch of the antenna array, each of the radiator elements includes an impedance matching transformer connected at its input side and in which a radiator terminating patch is connected to the end of each of the two mirror image branches.

3 Claims, 4 Drawing Sheets

FAR-FIELD PATTERN vs. AZIMUTH ANGLE (DEGREES)

CLOSE-UP OF 7A SHOWING 3dB BEAM ANGLE OF 4.5 DEGREES

HIGH PERFORMANCE TRAVELING WAVE ANTENNA FOR MICROWAVE AND MILLIMETER WAVE APPLICATIONS

FIELD OF THE INVENTION

The present invention relates to the field of microstrip array antennas which operate at microwave/millimeter frequencies. More particularly, the present invention relates to a high performance traveling wave antenna for microwave and millimeter wave applications such as point-to-point communications, cell-site stations and long-range communications having improved beam width, sidelobes and impedance matching performance.

BACKGROUND OF THE INVENTION

Prior art microstrip array antennas for use in point-to-point communications, with cell-site stations and with long-range communications applications, suffer from poor performance in the areas of beam width, sidelobes and impedance matching. Specifically, prior art microstrip array antennas do not optimally match each radiator element and waste RF power by using a terminating resistor at the end of the traveling wave antenna, which results in a loss of the RF power applied to the antenna, rather than the radiation of that RF power. Also, prior art microstrip array antennas do not achieve a high level of sidelobe control while producing a narrow beam width.

The present invention, on the other hand, optimizes radiator element design, improves impedance matching and sidelobe patterns and provides better phase coherence across the array, which enables a narrow beam width with low sidelobes and improves efficiency by eliminating the terminating resistor used in prior art designs. Thus, the antenna of the present invention is a traveling wave microstrip array antenna which produces a narrow beam width and low sidelobes at 39 GHz, provides better impedance matching and produces an efficient antenna array at microwave/millimeter frequencies including Ka-band (26.5–40.0 GHz) and above.

SUMMARY AND OBJECTS OF THE INVENTION

In view of the foregoing, it should be apparent that there still exists a need in the art for a traveling wave microstrip array antenna to be operated at microwave/millimeter wave frequencies which provides improved performance by optimizing radiator element design. It is, therefore, a primary object of this invention to provide a high performance traveling wave microstrip array antenna which has improved impedance matching characteristics and which has particular application for Ka-band frequencies and above.

It is a still further object of the present invention to provide a high performance traveling wave microstrip array antenna which is optimized to provide a narrow beam width as well as low sidelobes at microwave frequencies of the Ka-band.

Briefly described, these and other objects of the invention are accomplished by providing a traveling wave antenna array having left and right branches which contain radiator elements which are mirror images of each other. RF energy fed to the traveling wave antenna array is split by a 180 degree power splitter which then feeds the first radiator element of each of the two branches of the array. A termination patch is provided at the end of each array branch in order to reduce the traditional RF loss associated with the use of a terminating resistor element at the end of each branch.

Each of the radiator elements which form the traveling wave antenna array are designed such that they include an impedance matching transformer connected to the input of each of such radiator elements. In that manner, the input impedance and the output impedance of each individual radiator element are equal. Using the traveling wave antenna design of the present invention, which includes the compensated 180 degree power divider, the impedance matched radiators and a radiating termination element, the traveling wave antenna of the present invention obtains a high degree of control over the power weighting at each radiator element, which results in improved sidelobe levels with a narrow beam at millimeter wave frequencies.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
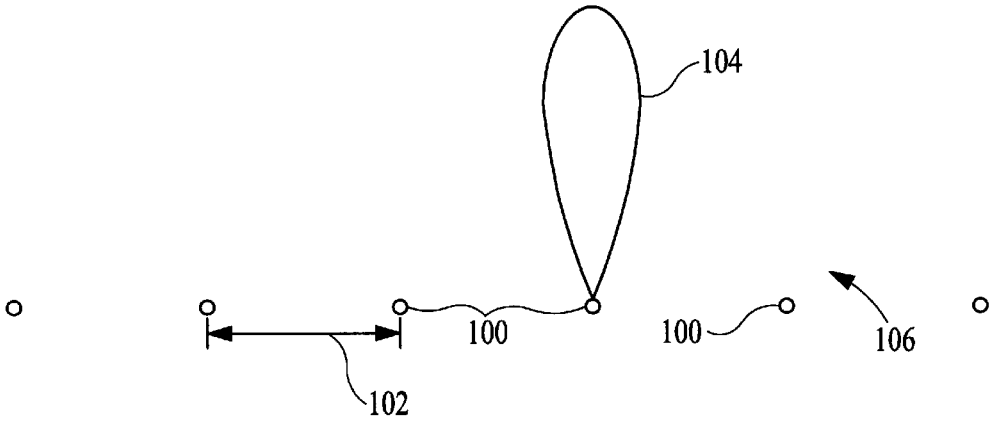
FIG. 1 is a drawing showing the details of a general antenna array.

Referring now in detail to the drawings wherein like parts are designated by like reference numerals throughout, there is illustrated in FIG. 1, by way of background, a conventional ideal linear array 106 of point sources 100, which, when separated electrically by 360 degrees 102, causes a beam 104 to be formed perpendicular to the array 106. All arrays consist of different techniques for achieving the described relationship of signal power and phase between array elements.

Figure 2:
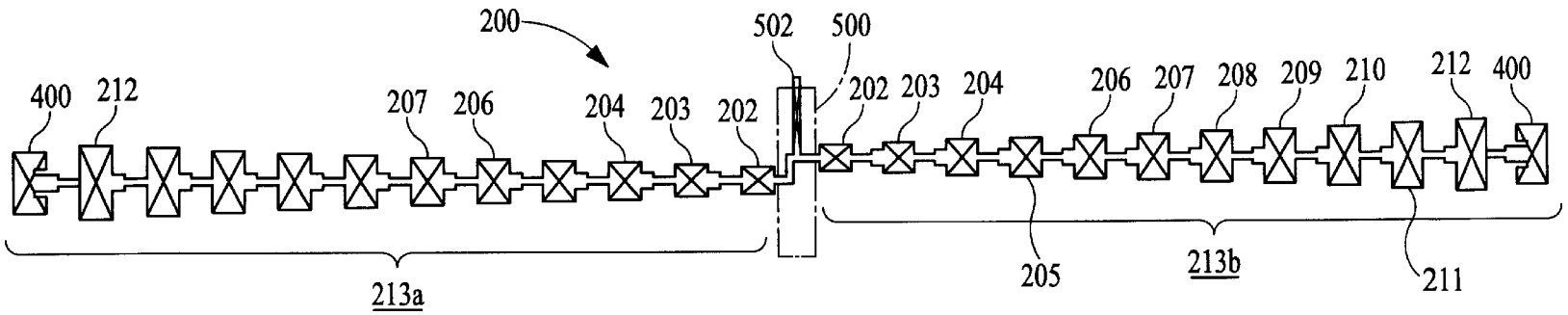
FIG. 2 is a drawing of a preferred embodiment of the traveling wave antenna array of the present invention.

The preferred embodiment of the traveling wave antenna of the present invention is shown in FIG. 2. Like all passive antennas, it is reciprocal; it can be used for either transmitting or receiving. For simplicity of description, its operation as a transmitter will be described. If used as a receiving antenna, each element serves the same purpose as in the transmitting antenna, with only the direction of signal flow reversed.

When used as a transmitting antenna, RF energy enters the array 200 at the input port 502 of a 180 degree power splitter 500. Each side of the power splitter 500 feeds a radiator element 202 of the same type. That is, the radiator elements 202, 203, . . . 212 on the left half or branch 213*a* of the array 200 are a mirror image of the radiator elements 202, 203, . . . 212 on the right half or branch 213*b* of the array 200. As the RF signal passes through each successive radiator out from the center of the array 200, the elements change size, but the left half 213*a* and right half 213*b* of the array 200 remain as mirrored geometry of each other. The series elements 202, 203, . . . 212 on each half 213*a*, 213*b* of the array 200 form a branch which are mirrored geometries of each other. At the end of each array branch 213*a*, 213*b*, is a radiating termination patch 400.

Figure 3:
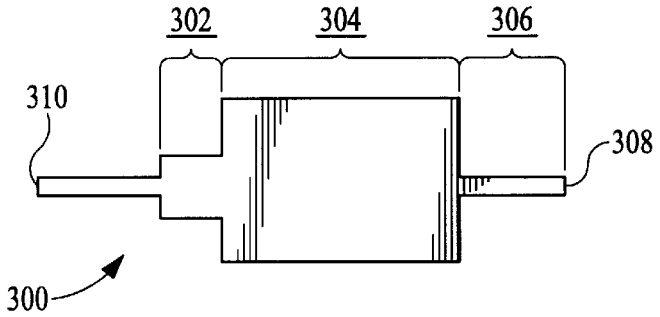
FIG. 3 is a schematic drawing of a single series feed radiating element utilized to construct the antenna array of FIG. 2.

Each series feed element 202, 203, . . . 212 consists of the structure 300 shown in FIG. 3. The input port 310 is connected to an impedance matching transformer 302. The output of the impedance matching transformer 302 is connected to the main radiating part 304 of the radiator 300. A section of transmission line 306 with length adjusted such that the electrical distance from the input port 310 to the output port 308 is 360 degrees is connected after the main radiating element 304. In addition, the input S-parameter of the main radiator element 304 is designed to be minimum through design of the transformer section 302.

Figure 4:
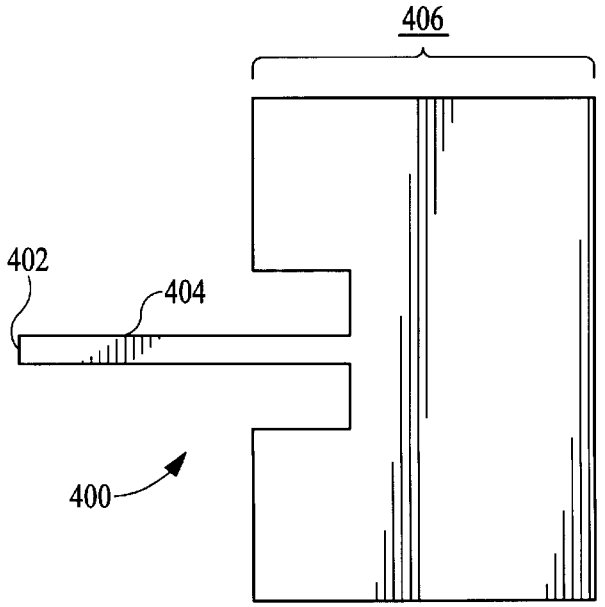
FIG. 4 is a schematic drawing of the radiating element used as a termination at the end of the antenna array of FIG. 2.

At the end of the preferred traveling wave antenna 200 is a conventional patch 400, the details of which are shown in FIG. 4. The patch 400 is used in a new way as a radiating termination for the traveling wave antenna 200. As shown in FIG. 4, the conventional patch 400 consists of an input port 402, an impedance matching section 404, and the main body of the radiator 406.

Figure 5:
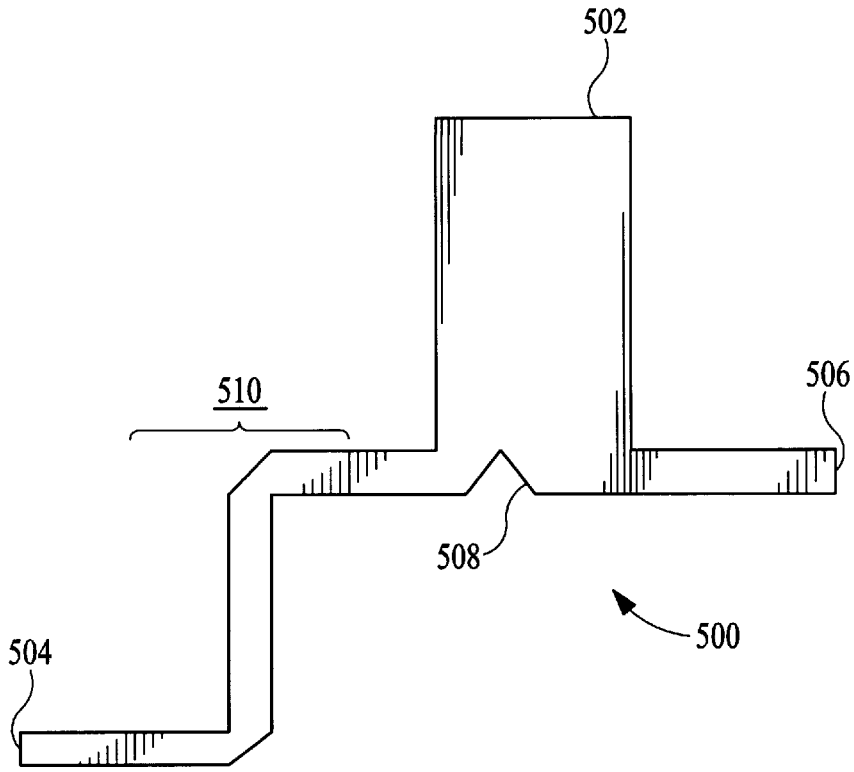
FIG. 5 is a schematic drawing of the power splitter which is used in constructing the antenna array of FIG. 2.

The power splitter 500 is shown in more detail in FIG. 5. The power splitter 500 consists of an input port 502, and two output ports 504, 506. The impedance of the input port 502 is preferably 50 ohms, while the impedance of the output ports 504, 506 are preferably 100 ohms each. The path to the output port 504 includes an extra section of transmission line 510 which is 180 electrical degrees in length at the antenna array's design frequency. The resulting phase at the output port 504 is electrically 180 degrees delayed with respect to the other output port 506. Because of the proximity of the 180 degree section of transmission line 510 to the power splitting junction, the notch 508 is offset to maintain a 50% symmetrical power split causing equal signal amplitudes at ports 504, 506.

The sidelobe level is controlled by the power weight on each element in each branch 213*a*, 213*b* across the array 200 and by the accuracy of the fabrication of those elements. For the present antenna 200, the relative power weights across the 24 elements are shown plotted in FIG. 6.

Figure 7A:
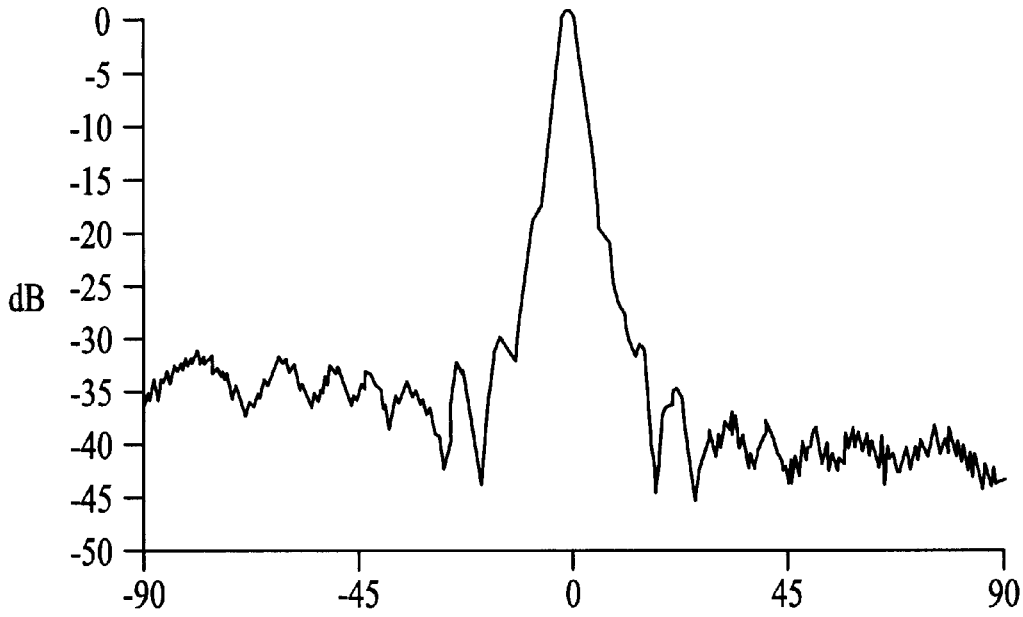
FIG. 7A is a graph showing the measured far-field pattern vs. azimuth angle of the antenna array of the present invention.
Figure 7B:
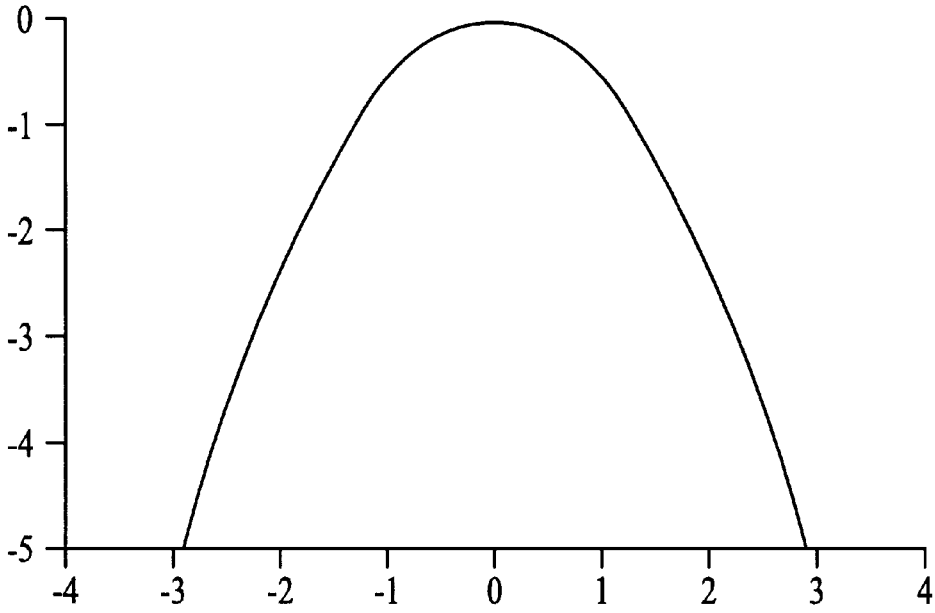
FIG. 7B is a graph showing the close-up of the beam pattern of FIG. 7A.

FIG. 7A shows a measured azimuth scan of a 24 element design of an antenna array 200 shown in FIG. 2 at 39 GHz. Of particular relevance is the first significant sidelobe level, which is at −30.0 dB. Farther out, the sidelobes extend periodically to as low as −40.0 dB. The close-up of the beam pattern is shown in FIG. 7B and indicates an exceptional 3 dB beam angle of 4.5 degrees.

Figure 8:
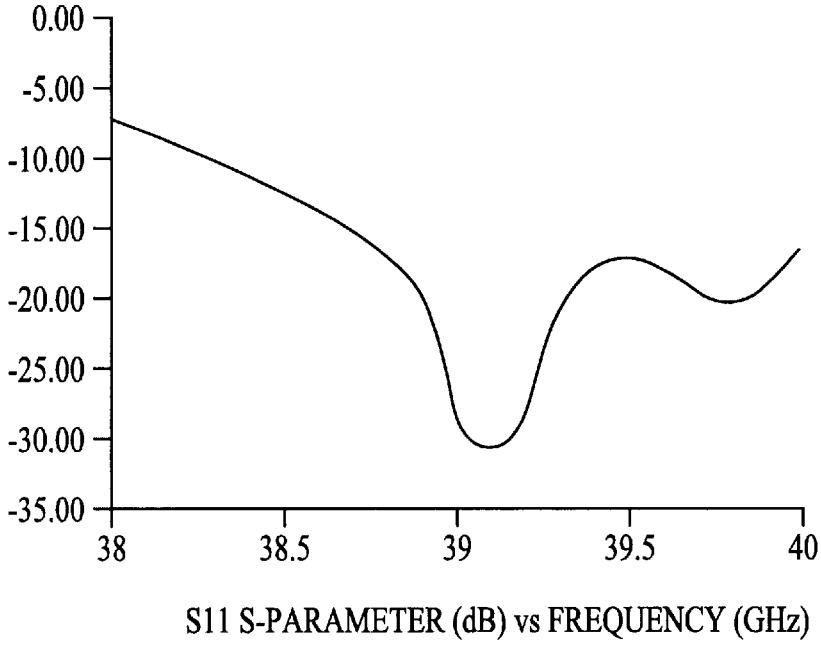
FIG. 8 is a graph showing the S11 S-parameter measurement of the antenna array of the present invention.

FIG. 8 shows the S11 S-parameter of the antenna array 200 shown in FIG. 2 at frequencies near the design frequency and is better than −25 dB at the design frequency 39 GHz.

In order to design an antenna array which incorporates the principles of the preferred embodiment discussed above, the following steps are performed. 1. Generate a termination patch 400, as shown in FIG. 4, having an input impedance Zo at the design frequency, using full wave electromagnetic simulation. 2. Generate a 180 degree power divider 500, as shown in FIG. 5, of input impedance Zo/2 and having output impedances Zo with output ports differing electrically in phase by 180 degrees at the design frequency, again using full wave electromagnetic simulation. 3. Build a small database of impedance matched and correctly phased radiator elements 300 at the design frequency, as shown in FIG. 3, also using full wave electromagnetic simulation.

The entries in the small database are as follows:

W(radiator) L(radiator) L(match) W(match) L(phase) P(radiated), where W(radiator) is the width of the main radiating portion 304 of the radiator 300 perpendicular to the direction of RF signal propagation, L(radiator) is the length of the main radiating portion 304 of the radiator 300 along the direction of RF signal propagation, W(match) is the width of the impedance matching section 302 of the radiator 300, L(match) is the length of the impedance matching section 302 of the radiator 300, L(phase) is the length of a section of transmission line 306 which forms part of the radiator 300 and P(radiated) is the power radiated as determined by a full wave electromagnetic simulation.

The database is built by optimizing radiator elements of different W(radiator) values for a minimum S11 reflection S-parameter and 360° electrical phase shift between radiator input and output at the intended design frequency, 39 GHz for example. This is accomplished by performing full wave electromagnetic simulation and adjusting L (radiator), L(match), W(match) as needed. Step 4 in designing an array is the generation of a set of power weights for each element using conventional theory. The fifth step is to find entries in the database both above and below the desired power weight. From the selected entries, a specific radiator design can be interpolated for use in the preferred antenna array design. The interpolation is carried out on the four variables: W(radiator), L(radiator), L(match), W(match).

In operation, the preferred antenna array works as follows. RF energy enters at the input port 502 of the power splitter 500 and is split into two signal parts of equal amplitude but differing in phase by 180 degrees. The RF signal then propagates along each branch 213*a*, 213*b* of the array 200, passing through a series of radiator elements 202, 203, . . . 212 and then to a patch 400. Conventional antenna design theory indicates that the wide sections of a transmission line carry a higher current than the narrow sections of a transmission line. Theory also states that radiation from a transmission line section is proportional to the square of the average RF current amplitude. As such, the wide sections of the transmission line serve as the radiator elements.

Figure 6:
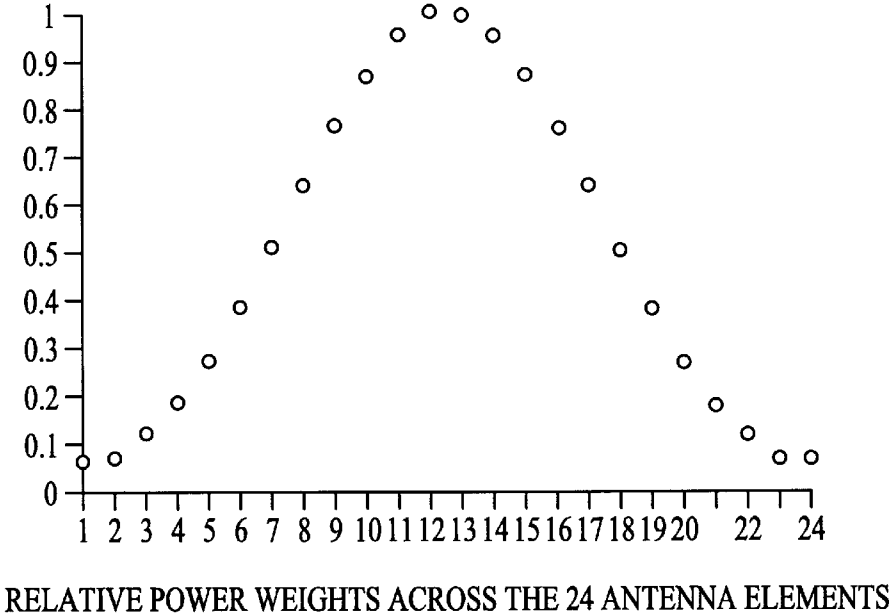
FIG. 6 is a graph showing the power-weight across the antenna array of the present invention.

By adjusting the width of the radiator sections as is done conventionally, the current amplitude on each radiator 202, 203, . . . 212 can be adjusted to effectively determine the power being radiated from each element. Adjustment of the power radiated from each element is necessary to control the spatial shape of the beam pattern radiated. The power weights are determined by conventional theory. The power weight distribution for the antenna array of the present invention as shown in FIG. 2 is shown in FIG. 6. That power weight distribution is very near to a conventional N-Taylor taper.

Because the elements radiate as the RF energy propagates along the radiator elements, the impedance at the input of the wide radiator section 304 of each element 300 is different from the impedance at the output 308 of each element 300. In order to preserve the impedance match at each radiator element and to enable numerous radiators to be arranged into a linear arrangement without a degradation of performance, the input impedance of each radiator must be transformed back to a value which equals the output impedance of the prior element. For a modular design, the output impedance of all elements are designed to be Zo and the transformed input impedance of all elements are designed to be Zo. By preserving the impedance match between each radiator element, the RF signal propagates from the input 502 toward each terminating patch 400 without significant reflections back to the input port 502. In the present design, element 302 serves as an impedance matching section whose length and width are adjusted to achieve an input impedance of Zo.

One additional requirement is necessary for the design of the radiator elements 300; the input and output ports 310, 308 of each radiator element 202, 203, . . . 212 must be separated by a fixed phase. By selecting a fixed phase of 360 electrical degrees, all radiators in an array will add constructively and form a beam perpendicular to the face of the antenna 200.

Alternatively, the choice of a different fixed phase angle between radiating elements can be used, as known in the art, to form a beam pointing differently than perpendicular. To achieve the phase requirement, a section of the transmission line 306 impedance matched to Zo is adjusted in length. Because it has an impedance of Zo, the transmission line 306 maintains the output impedance of the main radiator element 304 at Zo.

To accurately design the input impedance matching section 302 and the phase length adjusting section 306, a 2D full wave numerical electromagnetic simulator is used, as is known in the art.

Thus, RF energy propagates down the antenna array 200 with a portion of the RF energy radiating from each section 202, 203, . . . 212 of the wide transmission line until reaching each termination patch 400 which is used to radiate the remainder of the energy propagating on the line.

As will be obvious to those of ordinary skill in the art, alternate radiators to the patch 400 can be used as the termination radiator without altering the intention of that aspect of the present invention, which is the replacement of the conventional terminating resistor with a terminating radiator.

Although only a preferred embodiment is specifically illustrated and described herein, it will be appreciated that many modifications and variations of the present invention are possible in light of the above technology and within the purview of the appended claims without departing from the spirit and intended scope of the invention.

What is claimed is:

1. A microstrip array antenna for operating at microwave/millimeter frequencies, comprising:

an antenna array having a plurality of radiator elements arranged in two mirror image branches, each of said radiator elements having an input and an output;

an RF signal feed to each of said two mirror image branches of said antenna array;

a radiator terminating element attached respectively to an end of each of said two mirror image branches opposite said RF signal feed for reducing RF loss associated with the radiator terminating elements of said microstrip array antenna; and a 180 degree power splitter connected between said RF signal feed and said two mirror image branches of said antenna array, wherein said 180 degree power splitter has a compensated notch positioning means for equalizing its power division amplitude.

2. A traveling wave antenna for operating at microwave/millimeter frequencies, comprising:

an antenna array having a plurality of radiator elements arranged in two mirror image branches, each of said radiator elements having an input and an output;

an RF signal feed to each of said two mirror image branches of said antenna array;

a radiator terminating element attached respectively to an end of each of said two mirror image branches opposite said RF signal feed for reducing RF loss associated with the radiator terminating elements of said microstrip array antenna, wherein said radiator terminating element comprises a patch; and a 180 degree power splitter connected between said RF signal feed and said two mirror image branches of said antenna array, wherein said 180 degree power splitter has a compensated notch positioning means for equalizing its power division amplitude.

3. A method of operating a traveling wave antenna in order to achieve a high degree of control over power weighting at each radiator element for improved sidelobe levels and a narrow beam at millimeter/microwave frequencies, comprising the steps of:

forming an antenna array having a plurality of radiator elements arranged in two mirror image branches, each of said radiator elements having an input and an output;

connecting an RF signal feed to each of said two mirror image branches of said antenna array;

terminating an end of each of said two mirror image branches opposite an RF signal feed using a radiator terminating element for reducing RF loss associated with the radiator terminating elements of said traveling wave antenna; and symmetrically splitting the RF signal power applied to said two mirror image branches of said traveling wave antenna, wherein the step of symmetrically splitting said RF signal power is accomplished by a 180 degree power splitter having a compensated notch positioning means for equalizing its power division amplitude.

* * * * *